US007244509B1

(12) United States Patent
Seydel

(10) Patent No.: US 7,244,509 B1
(45) **Date of Patent: *Jul. 17, 2007**

(54) MOISTURE RESISTANT, REPULPABLE PAPER PRODUCTS AND METHOD OF MAKING SAME

(75) Inventor: Scott O. Seydel, Atlanta, GA (US)

(73) Assignee: EvCo Research, LLC

( * ) Notice: Subject to any disclaimer, the term of this patent is extended or adjusted under 35 U.S.C. 154(b) by 0 days.

This patent is subject to a terminal disclaimer.

(21) Appl. No.: 11/041,573

(22) Filed: Jan. 24, 2005

Related U.S. Application Data

(63) Continuation-in-part of application No. 10/409,238, filed on Apr. 8, 2003, now Pat. No. 6,846,573.

(60) Provisional application No. 60/373,952, filed on Apr. 19, 2002.

(51) Int. Cl.
*B32B 23/04* (2006.01)

(52) U.S. Cl. ..... 428/536; 428/537.5; 428/34.2; 427/324; 427/326; 427/334; 427/339; 427/415; 427/416; 156/325; 156/328; 156/332; 156/333

(58) Field of Classification Search ..... 428/537.5, 428/536, 34.2; 427/324, 326, 334, 339, 415, 427/416; 156/325, 328, 332, 333
See application file for complete search history.

(56) References Cited

U.S. PATENT DOCUMENTS

| | | | | |
|---|---|---|---|---|
| 2,691,606 | A | 10/1954 | Ziiiox | |
| 3,066,039 | A | 11/1962 | de Tienda y Ricon | |
| 3,108,889 | A | 10/1963 | Miranda | |
| RE29,272 | E | 6/1977 | Hintz | |
| 4,154,899 | A | 5/1979 | Hershey | |
| 4,253,840 | A | 3/1981 | Illman | |
| 4,260,643 | A | 4/1981 | Cochran | |
| 4,263,216 | A | 4/1981 | Volpenhein | |
| 4,348,460 | A | 9/1982 | Saunders | |
| 4,350,737 | A | 9/1982 | Saunders | |
| 4,385,436 | A | 5/1983 | Saunders | |
| 4,386,437 | A | 6/1983 | Fosher | |
| 4,390,590 | A | 6/1983 | Saunders | |
| 4,401,782 | A | 8/1983 | Conklin | |
| 4,406,055 | A | 9/1983 | Saunders | |
| 4,410,592 | A | 10/1983 | Saunders | |
| 4,449,290 | A | 5/1984 | Saunders | |
| 4,676,836 | A | 6/1987 | Hill | |
| 4,690,834 | A | 9/1987 | Appelgren | |
| 4,753,743 | A | 6/1988 | Sech | |
| 4,767,669 | A | 8/1988 | Conklin | |
| 4,853,038 | A | 8/1989 | Leithaeuser | |
| 5,069,806 | A | 12/1991 | Trivett | |
| 5,089,157 | A | 2/1992 | Trivett | |
| 5,229,023 | A | 7/1993 | Landis | |
| 5,491,190 | A | 2/1996 | Sandvick | |
| 5,587,202 | A | 12/1996 | Sandvick | |
| 5,665,426 | A | 9/1997 | Krzysik | |
| 5,670,463 | A | 9/1997 | Maples | |
| 5,700,516 | A | 12/1997 | Sandvick | |
| 5,879,512 | A | 3/1999 | McGerrity | |
| 5,880,064 | A | 3/1999 | Kagota | |
| 5,990,055 | A | 11/1999 | Garmier | |
| 6,103,308 | A * | 8/2000 | Floyd et al. | 427/363 |
| 6,143,113 | A | 11/2000 | Berube | |
| 6,162,771 | A | 12/2000 | Floyd | |
| 6,201,053 | B1 * | 3/2001 | Dieckmann et al. | 524/301 |
| 6,255,375 | B1 | 7/2001 | Michelman | |
| 6,419,791 | B1 | 7/2002 | Dragner | |
| 6,485,742 | B1 * | 11/2002 | Kakiguchi et al. | 424/464 |
| 6,541,556 | B1 | 4/2003 | Berube | |
| 6,811,824 | B2 | 11/2004 | Hassan et al. | |
| 6,846,573 | B2 * | 1/2005 | Seydel | 428/537.5 |

* cited by examiner

*Primary Examiner*—Leszek Kiliman
(74) *Attorney, Agent, or Firm*—McNair Law Firm, P.A.

(57) ABSTRACT

Hydrogenated triglycerides having melting temperature above about 50° C. are substituted for paraffin as a coating material for the surface of paper products and the resulting paper products have improved wet strength and moisture resistance in addition to being repulpable thereby providing a distinct environmental advantage over paraffin coated products.

5 Claims, 3 Drawing Sheets

MOISTURE RESISTANT, REPULPABLE PAPER PRODUCTS AND METHOD OF MAKING SAME

CROSS REFERENCE TO RELATED APPLICATION

This application is a continuation-in-part of Ser. No. 10/409,238 filed Apr. 8, 2003 now U.S. Pat. No. 6,846,573 which claims priority from provisional application Ser. No. 60/373,952 filed Apr. 19, 2002, having the same title and inventor.

FIELD OF THE INVENTION

This invention relates to moisture resistant and water proof paper products including linerboard, corrugated board having a fluted medium, and particularly to adhesives for the liner board and fluted medium. Also, one aspect of this invention relates to moisture resistant paper products that can be repulped and recycled to be part of the feedstock for new paper products. Further, in another aspect, this invention relates to the preparation and use of a moisture-proofing adhesives that can contain either petroleum wax or non-petroleum wax based, moisture-proofing materials.

BACKGROUND OF THE INVENTION

In the manufacture of paper and paperboard, and of products made from paper and paperboard, petroleum derived paraffin waxes and synthetic polymers have been used for many years as moisture retardants, water repellents, oil repellents, stiffeners, strengtheners, and release agents. Besides paraffin, the material used most often is probably polyethylene, but other widely used polymers include polymerized acrylics, vinyls, styrenes, ethylenes and copolymers or hetero-polymers of these monomers. For example, a polyester resin coating is described in U.S. Pat. No. 5,858,551 to Robert Keith Salsman. The paper and paperboard to which these traditional materials are applied becomes difficult and often impossible to repulp and recycle in standard paper mill processes because the petroleum derived polymers and, particularly, the petroleum waxes are non-biodegradable in mill white waters (circulated process waters) and discharge effluents, and the residue of the petroleum waxes that is not removed from pulp fibers during the repulping and recycling processes cause severe problems due to buildup that occurs on the screens and felts used during the process of forming and making the paper or paperboard sheet. In addition, paper and paperboard coated or impregnated with petroleum waxes resist biodegradation and composting when disposed of in landfills and other waste disposal systems. Paper and paperboard coated or impregnated with traditional synthetic polymers and hetero-polymers are also difficult and often impossible to repulp and recycle owing to their resistance to separation from the fiber in the standard repulping processes resulting in significant fiber losses in efforts to repulp and recycle them, and these are also non-biodegradable and therefore resist composting.

Accordingly, it is one object of the present invention to provide an improved method of waterproofing a paper product, particularly paperboard products with fluted media.

In the past, vegetable oil triglycerides have been used as coating lubricants for paper coatings in starch-based emulsions as described in U.S. Pat. No. 6,201,053 and in U.S. Pat. No. 6,103,308. A hot melt liquid used as a coating is described in U.S. Pat. No. 6,485,742 B1 which issued to Kakeguchi et al. While such emulsion coatings may provide some degree of water resistance, it is an object of the present invention to provide improved waterproofing and wet strength in starch based adhesive.

In another prior art patent, namely, U.S. Pat. No. 6,201,053 the use of a partially saponified triglyceride (PST) is disclosed where the PST may be a thickening agent, surfactant, water proofing agent, or coupling where PST consists of a homogeneous mixture of a metal salt, a fatty acid of said triglyceride, and a mixture of monoglyceride, diglyceride and triglyceride in the absence of a compatibilizing agent. These PST's are said to be useful as lubricants for paper surfaces and can act as water repellants but this process is one of saponification and not hydrogenation. Accordingly, it is another object of the present invention to provide an environmentally compatible alternative to paraffin wax and other coatings by employing hydrogenated triglycerides.

The foregoing and other objects are achieved by the present invention which is described below in the Summary of the Invention and Detailed Description.

SUMMARY OF THE INVENTION

In one aspect the present invention is the surprising discovery that meltable products such as hydrogenated vegetable oil or lard or tallow triglycerides or paraffin waxes can be incorporated into starch adhesives traditionally used in making corrugated paperboard thereby providing a moisture resistant adhesive for the paperboard. Thus, in another aspect the invention is a method of making a moisture resistant, paperboard product having a fluted paper medium positioned adjacent to or between paper liner boards comprising the steps of providing a starch based adhesive carrier; dispersing a finely divided meltable moisture proofing material in said carrier, said meltable material being selected from the group consisting of paraffin waxes and hydrogenated triglycerides having melting point range beginning at least as high as about 50° C., said meltable material being dispersed in said carrier in an amount of up to about 40% by weight of the starch solids to form an adhesive moisture proofing dispersion; and applying said adhesive dispersion to the contact surface of the flutes in sufficient quantity so that upon contact the dispersion will migrate into the paper comprising the fluted medium thereby carrying the moisture proofing material into the flutes. As generally used herein the terms "triglyceride" and "hydrogenated triglyceride" mean the product defined under the heading of "Summary of the Invention".

In another aspect of the invention, the dispersing step comprises the additional steps of preparing and cooking a portion of the starch adhesive thereby heating said starch to a temperature above the melting temperature of said moisture proofing material and then adding said material in solid particulate form to the heated starch whereby the material melts and is dispersed in said starch; and, mixing said heated starch with the uncooked portion prior to the step of applying starch to paperboard.

In a still further aspect, the invention includes the steps of preparing a firmly divided, meltable, moisture resistant material in the form of a powder comprising: providing a multi-step spray tower; melting said moisture proofing material and spraying said molten material into the uppermost part of said tower using a particulating nozzle while forcing cold air upwardly from the bottom of said tower whereby said molten particles solidify as they fall to the bottom of said tower; collecting said particles for dispersion in said starch.

In yet another aspect the invention is the method of making a moisture resistant corrugated paperboard having a paper fluted medium positioned between liner board surfaces comprising the steps of providing a starch based corrugated paperboard adhesive carrier; adding from about 20% to about 40% by weight of a hydrogenated triglyceride to said starch to form an adhesive mixture, said hydrogenated triglyceride preferably having a minimum melt temperature of about 50° C.; applying said adhesive mixture to the contact surfaces of said flutes; and, placing a fluted medium between said liner surfaces in contact therewith.

In a further aspect, the present invention is a repulpable, moisture resistant corrugated paper product comprising a paper substrate with a hydrogenated triglyceride coating on at least one surface and a starch based adhesive containing a meltable water proofing material has been applied to the contact surface of the fluted medium.

In still another aspect the present invention is a treated paper product and method of treating a paper product to make the product water resistant by applying a hot melt, hydrogenated triglyceride to a surface of the paper by spraying, rolling, or dipping the paper product. Said hot melt triglyceride preferably has a melting point in the range of about 55° (131° F.) to about 65° C. (148° F.) and is derived from edible grade vegetable or animal products. In some embodiments it has been found to be advantageous to add fumed silica and vegetable oil to hot melt triglycerides to improve gluing, printability, and appearance.

In yet another aspect, the invention is the process of waterproofing or moisture proofing substrates and adhesives for materials to be adhered to surfaces that are either woven or non-woven cellulosic materials or comprise a water absorbent material, said process having the step of coating said surface or substrate with a hydrogenated triglyceride having a minimum melting temperature of about 50° C. Specifically, the invention contemplates hydrogenated triglyceride coatings and adhesives for any water absorbent material or surface.

In another aspect the especially useful triglyceride used in starch adhesive composition in this invention can be characterized as a blend of triglycerides with carbon chain lengths of between C:14 and C:20 saturated and unsaturated. These triglycerides are then further processed to give desirable melting point ranges and rheological characteristics. The blends of natural, partially, and fully hydrogenated triglycerides are formulated to give amorphic crystalline structures that make suitable coatings for the paper industry.

In a further aspect of the invention, a novel, moisture resistant adhesive for bonding water absorbent surfaces together is provide which comprises up to 40% by weight of the hydrogenated triglyceride in a starch based carrier adhesive.

DESCRIPTION OF THE DRAWINGS

The invention will be more readily understood from a reading of the following specification and by reference to the accompanying drawings which form a part of the specification and illustrate one embodiment thereof.

DETAILED DESCRIPTION

Figure 1:
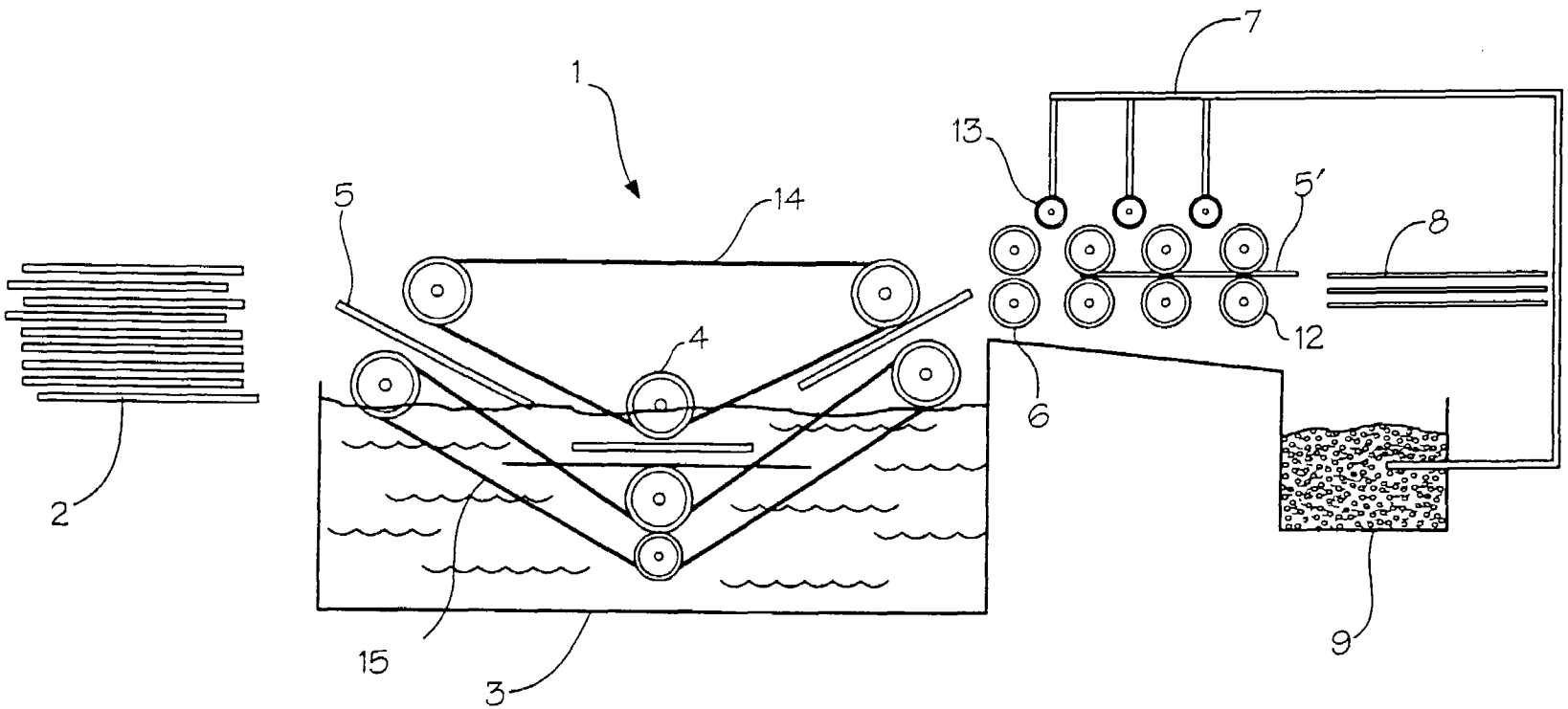
FIG. 1 is schematic representation of a process for coating and moisture proofing paperboard according to one embodiment of the invention.

In the paper making art it is well known that a device known as an "impregnator" is often installed on corrugating machines at a point between the creel or mounting for the roll of the paperboard medium that forms the corrugated fluting between the two outside liners of the corrugated board construction and the point at which the medium is taken up by the flute forming roll assembly. For examples of prior art methods of forming fluting in the manufacture of corrugated paperboard see U.S. Pat. No. 6,143,113 which issued Nov. 20, 2000 to Berube and U.S. Pat. No. Re. 29,272 which reissued on Jun. 21, 1997 to Hintz et al.

The impregnator is a "melted wax" applicator, fitted with rollers that press the hot melted wax, normally paraffin wax or paraffin wax based compounds, into and through the medium surface, thus saturating or impregnating the paperboard medium with the wax.

In far fewer instances, an impregnator may be installed on a roll-to-roll assembly to permit application of a meltable wax or wax based compound on the medium sheet prior to mounting the roll of medium on the corrugator, and in some rare instances, the impregnator may be installed at a paper machine which manufactures the medium sheet and then applies the meltable wax or wax based compound on the formed, dried sheet as it emerges from the machine.

When located on the corrugator, the medium sheet travels through the impregnator where the hot, meltable wax or wax based compound is applied, and after the impregnated medium (also known in the trade as "WIM" or "wax impregnated medium") is formed into flutes and a starch based adhesive is added to the flute contact points or places where the flute will be anchored to the two linerboards (also known as "SF" for "single face" linerboard and "DB" for double back" linerboard), it is mechanically affixed to the SF and/or DB liners and then conveyed through a long, heated, drying chamber to facilitate the cooking and drying of the starch based adhesive. Within this drying chamber, the temperature is sufficient to cause the paraffin wax within the WIM to melt and to partially migrate or flow from the WIM, over the drying adhesive that forms the flute bonds between the WIM and the SF and DB linerboards, and during this partial migration the product also partially coats the backside of the SF and DB liners, thus affording them some protection from water or high humidity moisture contact.

The use of WIM in corrugated board intended for use in forming boxes exposed to high humidity areas, or in conjunction with externally wax curtain coated corrugated boxes, is deemed to be essential to prevent moisture from penetrating to the interior of the corrugated board through vents, weep holes, or handle orifices or exposed cut edges. The WIM use affords both vertical and horizontal force resistance referred to in the trade as "stacking strength" and "edge crush" resistance respectively, and contributes to maintenance of these properties in the presence of high humidity or direct water contact.

The present invention avoids the necessity of installing an impregnator on a corrugating machine and obviates the need for "wax impregnated medium" or WIM in most of the corrugated perishable food packaging by a unique, novel method of delivering the meltable wax or similar material to a point of meltable migration or distribution to internal areas including the medium, flute bonds, and backsides of the "single face" or "SF" and "double back" or "DB" linerboards. The novel method utilizes a starch based adhesive carrier as the medium for dispersing, retaining in dispersion, storing, and delivering the meltable wax or similar material to a point within the corrugated board sufficiently centrally located so as to permit and encourage its migration to the medium, flute bonds, and backsides of the SF and DB linerboards.

Laboratory and commercial tests have demonstrated that in excess of twenty percent (20%) of the meltable material (based on the weight of the carrier starch, or "OWS" meaning "on the weight of the starch solids") can be delivered by this means, and tests with additional materials indicated that as much as forty percent (40% OWS) of an appropriate meltable wax or wax alternative can be dispersed in the starch based adhesive carrier and/or slurry and delivered to the corrugator by this method. For reference to starch based adhesives, see U.S. Pat. No. 5,405,437 which issued on Apr. 11, 1995 to Leake et al.

In the prior art, certain starch insolubilizers and water barrier resins have from time to time been added to starch based adhesive formulations; however, the purpose of these additives has been to make the starch adhesive itself resistant to moisture or direct water contact, rather than to use the starch formula as a carrier and distribution point for a meltable wax or alternative product intended as a substitute for WIM. Other additives intended to enhance adhesiveness, cohesiveness, and physical properties of the starch based adhesive have also been added, but again without intent to substitute the properties conveyed by wax impregnation or WIM.

The invention utilizes two physical forms of wax, wax based components, or wax alternative meltable products to accomplish the WIM substitution.

The first form of wax is a liquid melted product or a product in any convenient melted form such as chips, flakes, prill, powders, or molded blocks. These forms can be introduced to the starch based carrier portion of the corrugating adhesive during its cooking or preparation cycle. Since the temperature to which the mixture is raised during this cycle exceeds the melting point of the product, it will melt and disperse in the viscous carrier mixture in near microscopic particles that will remain dispersed owing to the colloidal effect of the highly viscous cooked starch. When the heated, cooked starch carrier is added to the ambient temperature starch slurry component of the corrugating adhesive, the abruptly lower temperature causes solidification of the near microscopic product particles, but does not result in their agglomeration or change in their small particle form. Thus, these small, dispersed product particles are delivered to the adhesive application point on the corrugator held within the bi-component adhesive by the viscosity of the mixture.

The second form of wax is a powdered solid product made by producing it in a spray tower or similar physical forming device. The spray tower is a very tall, multi-storied unit with the approximate dimensions of an elevator shaft within which cold air is forced upward while the hot melted product is pumped to and through particulating nozzles at the top most point of the tower, and is then allowed to drift downward whereupon the upward flow of refrigerated air causes the sprayed particles to solidify and accumulate in a particle feeding funnel at the tower base. This process forms the product into a fine powder which can then be easily dispersed in the ambient temperature starch slurry component of the two part, starch based adhesive system and from where it is maintained in a well dispersed mixture while being conveyed to the corrugator adhesive applicator.

It is believed that heretofore the hesitancy to consider or develop the foregoing methods of application was based on the assumption that additions of wax, wax based compounds, or meltable wax alternatives would inhibit the adhesiveness and cohesiveness of the starch based corrugating adhesive if added directly to the adhesive formulation, or that, being of considerably lower specific gravity and thus lighter than the water used in formulating the starch based adhesive, the product particles would float to the surface of the adhesive mixture and block substrate contact. However, neither is the case so long as the product is formulated from a fine powder or melted form within a highly agitated mixing tank.

Though both paraffin or natural wax and wax based compounds may be employed by means of this invention, a preferred product, namely, hydrogenated triglyceride as described herein and as mentioned in parent application, U.S. Ser. No. 10/409,238 that was filed Apr. 8, 2003, and which describes the hydrogenated triglyceride product as an alternative to traditional paraffin wax, wax compounds and chemically similar countertypes. This triglyceride product series, owing to its greater dispersability and closer specific gravity exhibits greater resistance to agglomeration, mass separation, or other problems that might reduce the effectiveness of the starch based adhesive or reduce the potency of the product in achieving the performance of the substituted WIM-based waxes.

The preferred product, as mentioned above, is the hydrogenated triglyceride sold under the brand name EvCor™ by EvCo Research Corporation of Atlanta, Ga.

Generally, the hydrogenated triglyceride products or treating compositions identified by the EvCor brand can be made from any vegetable or animal oil suitable for hydrogenation; however, the intended application will control the starting raw materials and the finished compound formulation in each case. Sources of such oils or fats include beef tallow, pork lard, poultry greases, fish oils, and the oils of coconut, palm, castor, olive, cottonseed, linseed, peanuts, soy, and corn, palm kernel, rape seed and canola. The selection variables are directed by desired properties, regulations, and cost (among others). Examples include the use of virgin vegetable oils only in coating linerboard, corrugated sheet, or folding carton stock if it is to be used to package Kosher foods; or, only materials that have been produced and maintained by specific means and standards that are in conformity with the regulations of the Food & Drug Administration and that can be used for packaging for wet food contact; and, only materials that can yield high temperature melting points that can be used on boxes that are to be packed in tropical areas.

The basic raw materials can be from virgin vegetable sources or they can be the same oils after use in food preparation processes such as fryers and then appropriately reclaimed for use in the present invention. They can originate from poultry factories that prepare chicken for fast food restaurants by precooking them and gathering the residual fats for use in the process of this invention.

A preferred vegetable product is hydrogenated soybean oil triglycerides, and even though more expensive than alternatives, it finds uses in many applications. Soybean oil's unique properties permit its use in all currently tested applications. These range from folding carton fish boxes to poultry plant bin boxes with many varied applications in between. In addition, these hydrogenated triglycerides generally have a higher flash point than paraffin.

The properties of the preferred soybean oil triglyceride can be varied by the process of hydrogenation, that is, a wide range of melting and hardening properties can be achieved that are similar to those of petroleum waxes. The pertinent properties of three of the preferred hydrogenated soybean oil triglycerides, A, B, and C are set forth in Table I below:

TABLE I

| Product: | A | B | C |
|---|---|---|---|
| Appearance | Waxy | Waxy | Waxy |
| Solids | 100% | 100% | 100% |
| Melting Point | 60–65° C. | 58–64° C. | 56–60° C. |
| Moisture, % | 0.2, max | 0.2, max | 0.2, max |
| Iodine Value, $Cgl_2/g$ | 2, max | 8–12 | 18–22 |
| Acid Value, Mg KOH/g | 2, max | 2, max | 2, max |
| Saponification #, Mg KOH/g | 195–205 | 195–205 | 195–205 |

The above hydrogenated products are from edible grade oil that can be certified as Kosher and are totally biodegradable and digestible.

Referring now to FIG. 1, a schematic representation of a typical and preferred commercial production line 1 is shown wherein a sheet of corrugated paperboard 5' is fed from a stack of corrugated paperboard in sheet feeder 8 through feed rollers 12 under applicator sprayers 13 that are fed by lines 7 carrying hot melt hydrogenated triglyceride from melt tank 9.

In a preferred embodiment, the fluted medium of the corrugated board has been adhered to the liner board by the starch based adhesive of this invention.

The coated boards then travel between conveyor belts 14 and 15 into cooling water bath 3 where the rollers 4 keep the sheets 5 submerged so that the coating will harden. The sheets 5 are then stacked in stack 2. Rather than being single layer sheets the stack 8 of sheets 5' can be flattened box preforms and the spray can then cover the entire exterior surface of the box-to-be-formed by adding additional sprayers 13 to coat the boxes from the bottom side.

To compare the coatings according to the invention with standard paraffin (petroleum) coatings, samples resulting from the application as in FIG. 1 of paraffin waxes and a similar coating of hydrogenated triglyceride to carton stock paperboard were cut into two inch strips and partially submerged in ambient temperature water to test wicking properties. The total test duration extended to five days, with burst tests performed at three days. The water wicking and residual strength of the tested samples were then tested. The results are shown as follows in Table II.

TABLE II

| | Water pick up | | | | |
|---|---|---|---|---|---|
| Coating | $g/in^2$ | % of fiber weight | Tensile kgs. | Burst* $lbs/in^2$ | Wicking mm/3.7 hrs |
| Paraffin wax | 0.90 | 126.5 | 12.37 | 39.3 | 50 |
| Triglyceride | 0.56 | 80.2 | 25.28 | 78.3 | 15 |

*Burst is tested with 3 days wicked board

Figure 2:
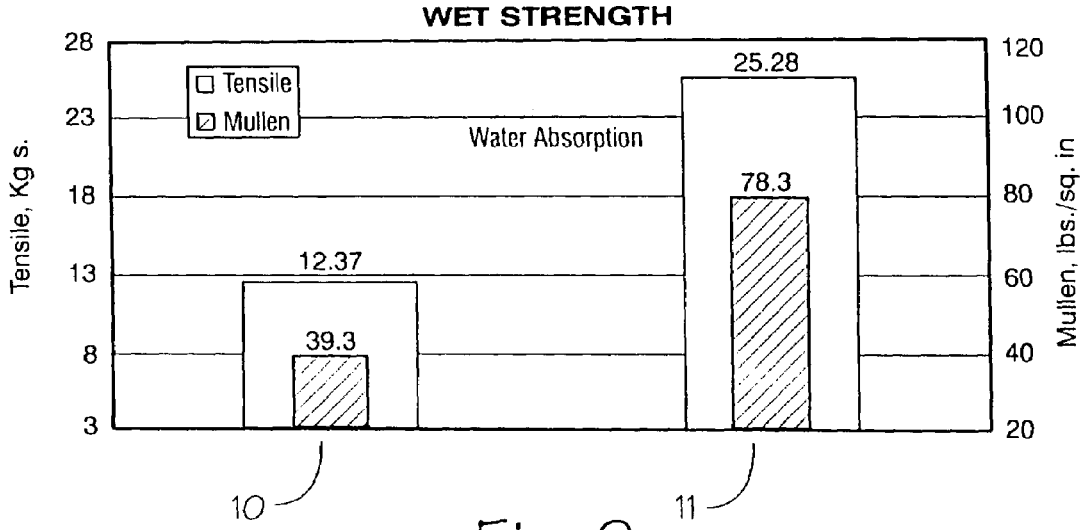
FIG. 2 is a bar graph comparing the wet strength of paraffin wax coated paperboard and paperboard treated according to an embodiment of the invention.

The wet strength differences are shown graphically in FIG. 2 where the paraffin wax coated paperboard is represented by bar 10 and the hydrogenated triglyceride of the invention is represented by bar 11.

The hydrogenated triglyceride consistently delivers greater water resistance than paraffin wax which microscopic examination suggests is due to higher fiber penetration. This overall superior water resistance of the hydrogenated triglyceride then contributes to the maintenance of higher comparative three-day wet strength in the coated board samples.

Figure 3:
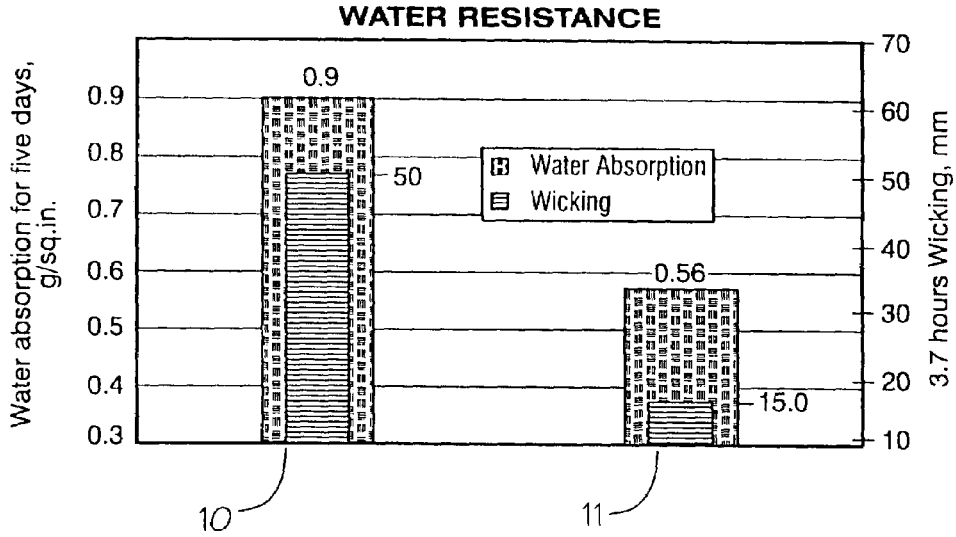
FIG. 3 is a comparison of the water resistance of paperboard coated with paraffin wax with paperboard treated according to a process of an embodiment of the present invention.

The water resistance is graphically shown in FIG. 3 where the paraffin is represented by bar 10 and the hydrogenated triglyceride is represented by bar 11. The wicking and absorption by the triglyceride coating is clearly lower. The foregoing demonstrates the moisture resistance superiority of paper products coated with hydrogenated triglyceride.

The use and concentration of the hydrogenated triglyceride coatings varies with the end-use application and the process machinery. Typically coatings on paperboard may range from 2 to 12 pounds (lbs.) per thousand square feet (mft). Preferably this would be in the range of 3 to 9 lbs/mft. These are not limiting ranges but exemplary ranges.

One preferred coating concentration is about 4 lbs/mft. In general the coating weights are less than those required by paraffin.

Although the superiority of corrugated paperboard treated with hydrogenated triglyceride is demonstrated above, paraffin treated board is a highly useful product and the use of paraffin (wax) based meltable in the starch based adhesive carrier as described herein provides a superior bonding for the medium to the liner board.

Returning now to the novel use of the hydrogenated triglyceride with a starch based adhesive, in the prior art in U.S. Pat. No. 6,056,816 granted to Hagens a method is disclosed whereby the addition of alkali silicate is claimed to enhance certain adhesive properties and the total adhesive solution solids. Increasing solids without correspondingly increasing the adhesive solution viscosity minimizes the water content that must be evaporated on the corrugator, and in that drying time/capacity is often the principal corrugating machine speed limitation. The patentee claims that the alkali silicate addition permits faster, more efficient corrugating.

In this regard, it has been discovered that the addition of the EvCor™ hydrogenated triglyceride to the starch carrier component of the traditional starch based adhesive systems increases solids without materially affecting the starch viscosity with starch solids in the range from 1% to 20%, thus providing a similar speed/efficiency advantage to that described in U.S. Pat. No. 6,056,816 to Hagens mentioned above.

More importantly, it has been discovered that when using a starch thinner, such as an oxidizing agent or enzyme, or when using a modified carrier starch, such as an acid modified, ethoxylated, etherized, or carboxylated starch (which modifications generally result in a lower viscosity-per-solids ratio), the carrier starch preparation can accommodate even higher percentages of EvCor™ product addition, and correspondingly higher total solids with lower water content, without requiring reductions in the starch solids owning to maximum viscosity tolerances.

In a series of confidential trials completed at a paper plant, the trials were conducted to determine that the addition of the triglyceride product (EvCor) to the corrugating process by a delivery means utilizing the starch based adhesive would have no negative effect on the adhesive properties or machine operation. As projected, based on preliminary laboratory investigations and past experience with similar products used as lubricants in textile sizing applications, these trials were successful in verifying that the addition of the EvCor™ triglyceride product to a prior art, standard carrier starch formulation corrugated board that is well known to those skilled in the art can be accomplished without materially affecting mix viscosity or reaching an accelerated viscosity level that would adversely affect the essential properties of the adhesive.

In addition, these trials verified that the hydrogenated triglyceride product included in the corrugating adhesive does not interfere with the operation of the corrugator, the application of an adhesive, or the basic and essential properties of the corrugated board.

Samples were taken from the corrugator of both standard corrugated sheets and sheets produced with hydrogenated triglyceride added to the standard adhesive formulation in levels up to and over 25% of the starch solids in the formula. Though it is not considered that such high levels would be targeted in normal operations, the higher additions were tested to determine at what point it may be anticipated that the triglyceride presence would be detrimental to the essential properties of the adhesive.

At 25% triglyceride addition, the viscosity effect of the higher total solids requires a reduction in the starch solids, reducing the overall starch solids in the adhesive and thus the strength of the adhesive bond. There was less starch deposited on the flute and thus less adhesive in the bond. However, the starch carrier adhesive component provides an adequate triglyceride delivery system.

Figure 4:
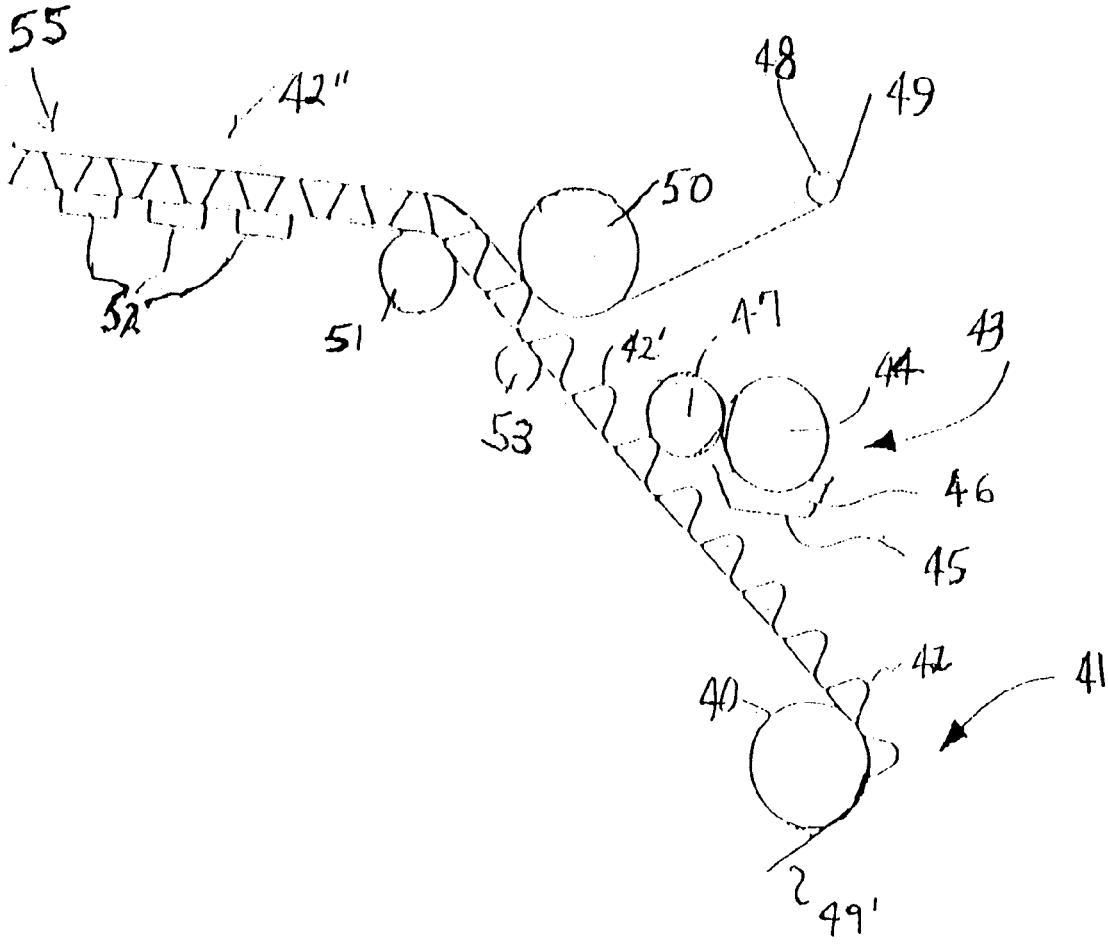
FIG. 4 is a representation of a starch based adhesive according to the present invention being applied to the flutes of a paperboard medium.

Turning now to FIG. 4, the process of applying the preferred starch/hydrogenated triglyceride adhesive will be described. Preformed flutes 42 or medium arrive at station 41 where they pass over a stabilizing and tensioning roller 40. The flutes move towards applicator roller 47 which has been coated with starch based adhesive 46 from reservoir 45 by coating roller 44. The adhesive is a preferred composition with the EvCor™ product. The flutes 42' to which adhesive has been applied now move towards liner roller 50 which applies liner 49 guided by liner tension roller 48 onto flutes 42' which are supported by support roller 51 as the flutes move across corner roller 51 and pass over heated guides 52 to emerge as flutes 42" adhered to the liner 49. The flutes may now be sandwiched between an additional sheet of liner board after having the opposite surface of the medium coated (not shown) with adhesive to form finished corrugated board. The corrugated board preferably may be treated as described above for FIG. 1. When the paperboard medium is secured to the liners by the starch adhesive/triglyceride adhesive of this invention, the adhesive bond is moisture resistant because the adhesive penetrates the fluted medium in the bond area thus making a substantially waterproofed paperboard. That is, not only are the liner and flute surfaces coated with a waterproofing material, the bonds themselves are waterproof. Without the adhesive of this invention the bonds formed by non-waterproof starch adhesive, even though dipped in waterproofing coatings, are likely to fail as the coatings rarely penetrate and seal completely the fluted medium and bonding surfaces.

In addition, the adhesive of this invention not only penetrates in the seal area of the fluted medium, it also migrates into the flutes making them waterproof making it possible to eliminate the impregnator as mentioned above. Thus, only the liner need be coated with waterproofing material as the flutes will be waterproofed as the adhesive is applied. In this manner, a unique, novel corrugated board is produced. In FIG. 4, for example, when the fluted medium 42 is first adhered to a medium 49' coated with the hydrogenated triglyceride coating of this invention, and the starch/triglyceride adhesive is used as the bonding agent, and the second triglyceride coated liner is applied, the resulting paperboard product has triglyceride coated linerboards with a fluted medium there between which has absorbed the starch/triglyceride adhesive.

Upon reading the foregoing specification, those skilled in the art may realize further embodiment which are within the scope of my invention which is limited only by the claims which follow:

What is claimed is:

1. A moisture resistant corrugated paperboard comprising:

a) a paper liner the surfaces of which are coated with a hydrogenated triglyceride having a melt temperature of at least about 50° C.; and b) a fluted paper medium adhered to a surface of said liner by an adhesive comprising a starch based carrier and a hydrogenated triglyceride having a melt temperature of at least about 50° C.

2. The corrugated paperboard of claim 1 wherein the fluted medium is sandwiched between two paper liners.

3. The corrugated paperboard of claim 1 wherein the adhesive comprises from about 20% to about 40% by weight of a hydrogenated triglyceride having a minimum melt temperature of about 55° C.

4. An adhesive for adhering one water absorbent surface to another comprising:

a) a starch based adhesive carrier and b) up to 40% by weight of a hydrogenated triglyceride having a minimum melt temperature of about 50° C.

5. The adhesive of claim 4 wherein the adhesive is for bonding one paper surface to another.

* * * * *